United States Patent [19]

Poluhowich

[11] Patent Number: 4,753,377

[45] Date of Patent: Jun. 28, 1988

[54] SURVIVAL BELT BUCKLE

[76] Inventor: John J. Poluhowich, 58 Hunsley Hills Blvd., Canyon, Tex. 79015

[21] Appl. No.: 35,053

[22] Filed: Apr. 6, 1987

[51] Int. Cl.[4] ..... A45C 15/00; B26B 3/06

[52] U.S. Cl. ..... 224/163; 224/904; 224/232; 206/803; 2/338; 24/163 K; 24/176; 24/3 F; 30/151; 30/156

[58] Field of Search ..... 224/163, 101, 151, 191, 224/219, 224, 225, 232, 904; 206/803; 2/322, 321, 338; D2/380, 378; 24/163 K, 170, 3 F, 176; 30/151, 156, 162, 339, 123, 340

[56] References Cited

U.S. PATENT DOCUMENTS

| | | | |
|---|---|---|---|
| 1,508,963 | 9/1924 | Dort | 224/163 |
| 2,507,019 | 9/1950 | Johnson | 30/151 |
| 3,148,426 | 9/1964 | Lesser et al. | 224/163 X |
| 3,927,442 | 12/1975 | Foster | 24/163 K |
| 3,929,223 | 12/1975 | Ludeman | 206/803 X |
| 4,030,646 | 6/1977 | Switack et al. | 224/163 |
| 4,096,979 | 6/1978 | Collins | 24/163 K X |
| 4,384,390 | 5/1983 | Hayakawa | 24/163 K X |
| 4,389,775 | 6/1983 | Collins | 24/163 K X |
| 4,466,561 | 8/1983 | Slaughter | 224/163 |
| 4,481,712 | 11/1984 | Phelps | 30/151 |
| 4,502,188 | 3/1985 | Kohli | 24/163 K |
| 4,529,111 | 7/1985 | Hayakawa | 224/163 |
| 4,562,620 | 1/1986 | Oliver, Jr. | 24/163 K |

FOREIGN PATENT DOCUMENTS

| | | | |
|---|---|---|---|
| 149853 | 12/1931 | Switzerland | 224/163 |
| 1515451 | 6/1978 | United Kingdom | 224/163 |

*Primary Examiner*—Henry J. Recla
*Assistant Examiner*—Ernest G. Cusick
*Attorney, Agent, or Firm*—K. Bradford Adolphson

[57] ABSTRACT

A survival belt buckle is provided with a compartment for retaining a multiplicity of items for aiding in the survival of the user in wilderness areas and the like. A knife blade is dimensionally sized to fit within the compartment and is releasably attachable to a portion of the survival belt buckle to permit the buckle to act as a handle therefor. The survival belt buckle includes indicia associated therewith providing a basic description of survival techniques and skills allowing the buckle to be used with maximum efficiency by inexperienced persons.

32 Claims, 3 Drawing Sheets

FIG. 8
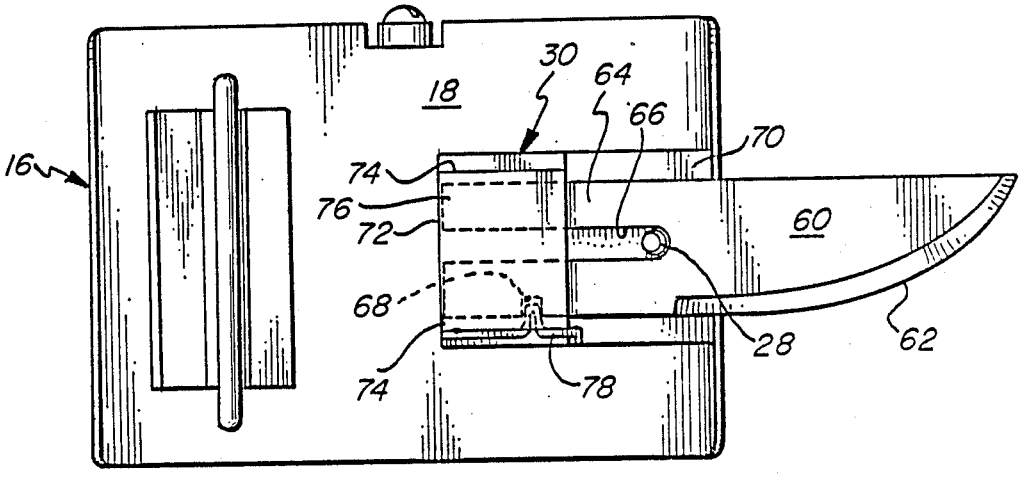
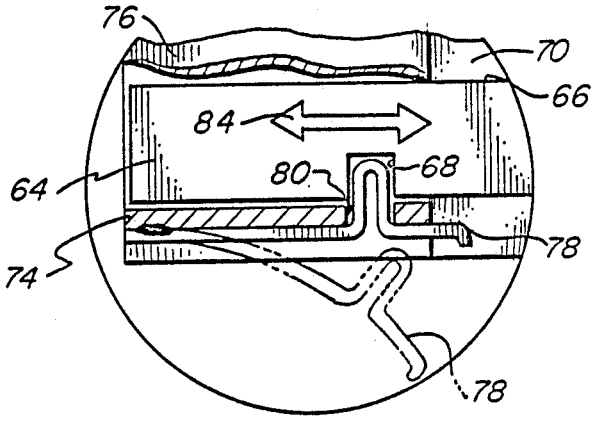
FIG. 9

SURVIVAL BELT BUCKLE

BACKGROUND OF THE INVENTION

The present invention relates generally to belt buckles and the like, and more particularly to a survival belt buckle.

In recent years, outdoor activities such as hiking, backpacking, hunting, fishing, etc. have become increasingly popular. With an increasing number of inexperienced people undertaking these activities, many of these individuals, according to many news reports, have found themselves stranded or lost in remote wilderness areas. For the most part, these individuals are unprepared to survive for any length of time in this strange new unhospitable environment and find themselves in dire straights. In addition, other individuals, such as plane crash victims, find themselves involuntarily thrust into similar precarious situations.

Survival knives have been developed to provide a degree of safety for those who venture into the out-of-doors. These knives have hollow handles which contain a limited number of items needed for wilderness survival. However, one of the major drawbacks of such survival knives is that they are relatively large and clumsy and, therefore, inconvenient to carry and use. Chances are that when an individual really needs such a knife, they will not have it. Additionally, the inexperienced person would not know the proper techniques for utilizing these survival knives thereby greatly diminishing the effectiveness and usefulness thereof.

The present invention is designed to overcome the above noted limitations of the "prior art" devices, and toward this end contemplates the provision of a novel survival belt buckle capable of providing the basic means and instructions for survival to those who venture into the out-of-doors.

It is also an object to provide such a belt buckle which includes a compartment for storing items which can be utilized in emergency survival situations.

Still another object is to provide a knife blade releasably securable to the belt buckle and dimensionally sized for storage in the compartment thereof.

A further object is to provide such a belt buckle which may be readily and economically fabricated and will enjoy a long life in operation.

SUMMARY OF THE INVENTION

It has now been found that the foregoing and related objects can be readily attained in a survival belt buckle for use in combination with an elongated belt comprising a base plate having a belt hook and a belt retaining ring for releasably securing the ends of the elongated belt on one side thereof and a case defining a compartment releasably mounted on the other side thereof.

In the preferred embodiment, the case has a generally rectangular configuration comprising a generally rectangular face plate, and a pair of end walls and a pair of side walls extending from the face plate to define the compartment. The end walls have extending shoulders releasably received in slots provided by a pair of L-shaped flanges extending outwardly from the base plate. The base plate has a rotating lock for holding the case in place within the slots defined by the L-shaped flanges.

Ideally, a number of items for aiding in the survival of the user are releasably retained within the compartment and are chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

Conveniently, the survival belt buckle is provided with indicia, associated with the case and base plate, in the form of a description of basic survival skills and techniques. The indicia can be engraved on the case and base plate or printed on separate cards dimensioned to be insertable in the compartment.

A further feature includes a knife blade releasably securable to a knife blade retainer on the base plate and dimensionally sized to fit within the compartment whereby the base plate acts as a handle for the knife blade when it is in its releasably secured position in the retainer. The knife blade retainer is a U-shaped member having two upstanding side walls with a traversing wall therebetween to define a channel within which is received an end of the knife blade. One of the side walls has an opening providing access into the channel.

Desirably, the end of the knife blade within the retainer includes a notch for receiving a locking spring dimensionally sized to enter the notch and retain the knife blade within the channel. The locking spring is mounted on the side wall with the opening for movement between a position seated within the opening and extending into the channel and a retracted position withdrawn from the opening and channel. The end of the knife blade insertable within the retainer includes an elongated slot dimensionally sized to receive the belt hook whereby the belt hook is received within the elongated slot to limit longitudinal movement of the knife blade.

The invention will be fully understood when reference is made to the following detailed description taken in conjuction with the accompanying drawings.

BRIEF DESCRIPTION OF THE DRAWINGS

FIG. 8 is a rear elevational view of the survival belt showing the knife blade releasably secured to the knife blade retainer on the rear of the base plate; and FIG. 9 is an enlarged fragmentary view of the retaining mechanism for the knife blade.

DESCRIPTION OF THE PREFERRED EMBODIMENT

Figure 1:
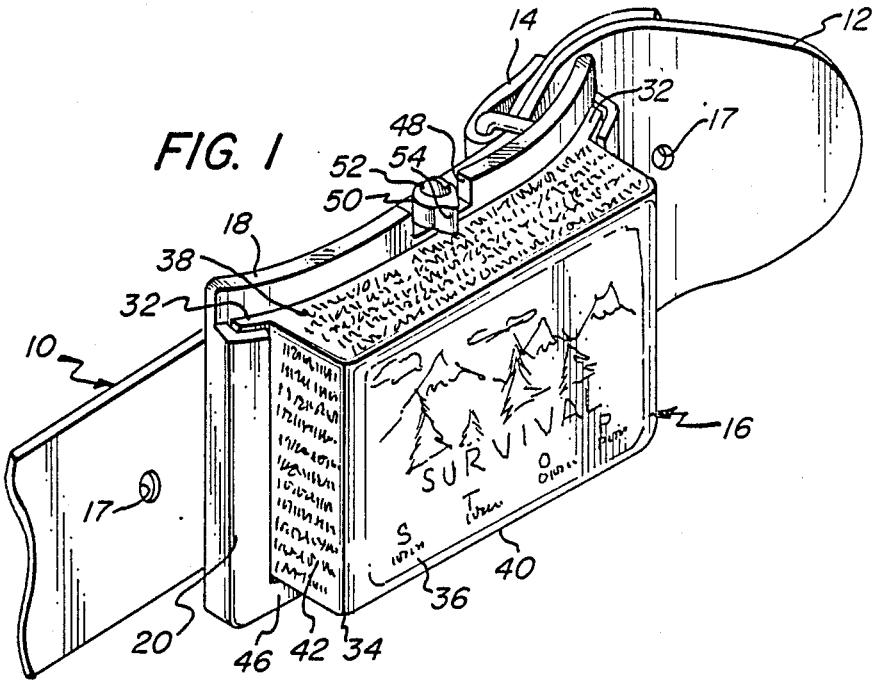
FIG. 1 is a perspective view of an elongated belt and a survival belt buckle embodying the present invention.

Referring first to FIG. 1, therein is illustrated an elongated belt generally indicated by numeral 10 having its two ends 12 and 14 releasably secured together by a survival belt buckle embodying the present invention and generally indicated by the numeral 16. The elongated belt 10 is used as wearing apparel and has a plurality of apertures 17 spaced therealong for adjusting the size of the belt to the waist of the user in a well known fashion.

Figure 2:
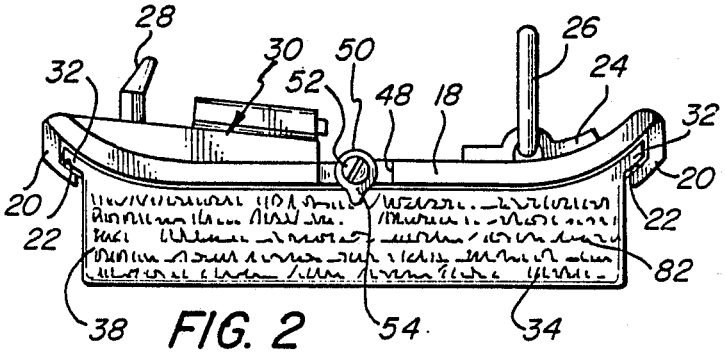
FIG. 2 is a top elevational view of the survival belt buckle.
Figure 3:
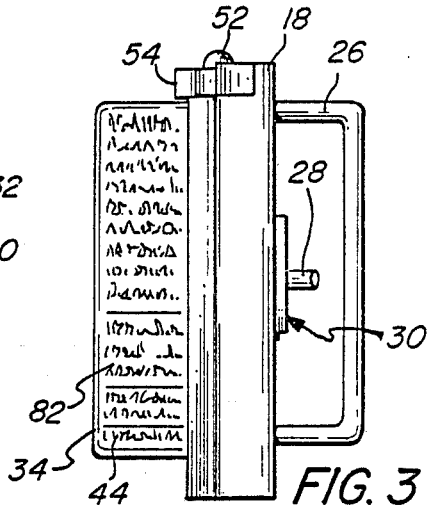
FIG. 3 is a right side elevational view of the survival belt buckle.
Figure 4:
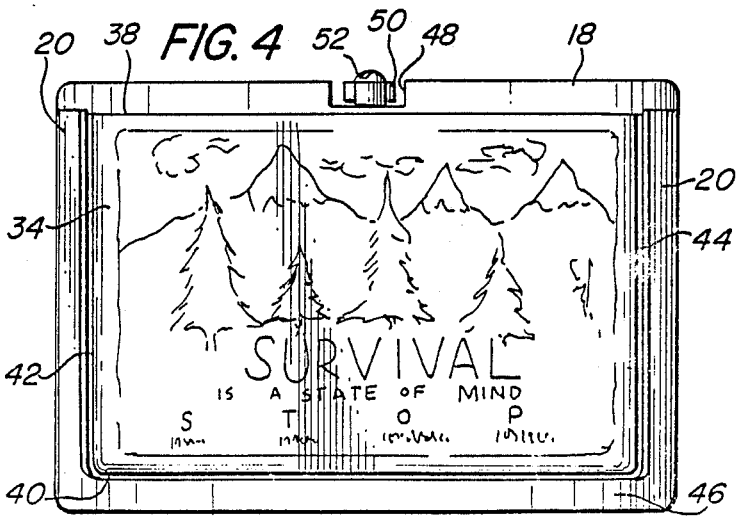
FIG. 4 is a front elevational view of the survival belt buckle.
Figure 5:
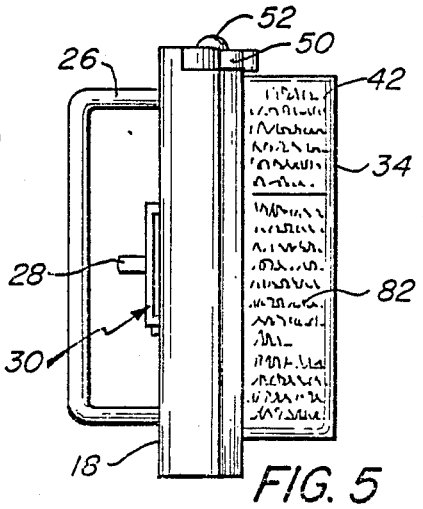
FIG. 5 is a left side elevational view of the survival belt buckle.
Figure 6:
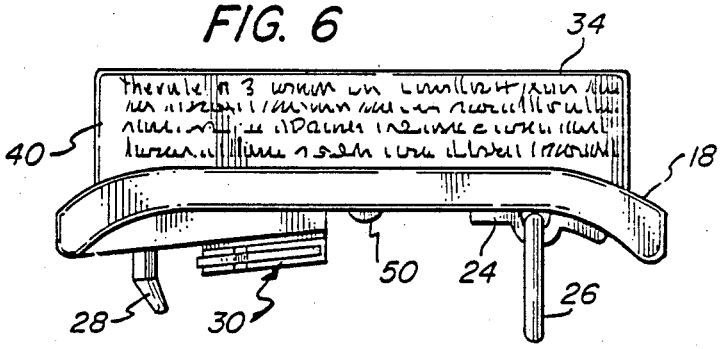
FIG. 6 is a bottom elevational view of the survival belt buckle.

The survival belt buckle 16 has a generally rectangular base plate 18 having a slightly curved configuration to approximate the natural curve of the body of the user. As seen in FIG. 2, located at the outer sides of the base plate 18 are two L-shaped extending flanges 20 cantilevered forwardly and inwardly thereby forming oppositely disposed curved slots 22. Pivotally mounted on the rear, concave side of the base plate 18 by means of a bracket 24 is a belt retaining ring 26 through which the end 14 of the elongated belt 10 is looped and secured. Also mounted on the rear side of the base plate 18 is a belt retaining hook 28 adapted to engage the elongated belt 10 in the plurality of apertures 17 thereby permitting adjustment thereof around the waist of the user. The free end 12 of the belt 10 is also inserted through the belt retaining ring 26. The base plate 18 also includes a knife blade retainer generally indicated by numeral 30 for a purpose and operating in a manner that will be made clear hereinafter.

Releasably mounted on the front, convex side of the base plate 18 is a case 34 having extending shoulders 32 slideably received within the slots 22. The case 34 has a generally rectangular configuration; however, the case 34 and its shoulders 32 are curved along the side that meets the base plate 18 to match the convex curve thereof. The shoulders 32 are dimensionally sized to be slideably received within the curved slots 22. The case 34 comprises a generally rectangular face plate 36 with a pair of end walls 38, 40 and a pair of side walls 42, 44 extending therefrom. The lower front portion 46 of the base plate 18 protrudes outwardly to provide an abutment surface on which the end wall 40 of the case 34 can seat.

Located within a cutout 48 in the base plate 18 is a lock or latch 50 pivotably mounted to the base plate 18 by a screw 52. The latch 50, in its closed position with its extending finger 54 located over the case 34 as illustrated in FIG. 1, prevents upward sliding movement of the case 34 within the curved slots 22 of the base plate 18.

Figure 7:
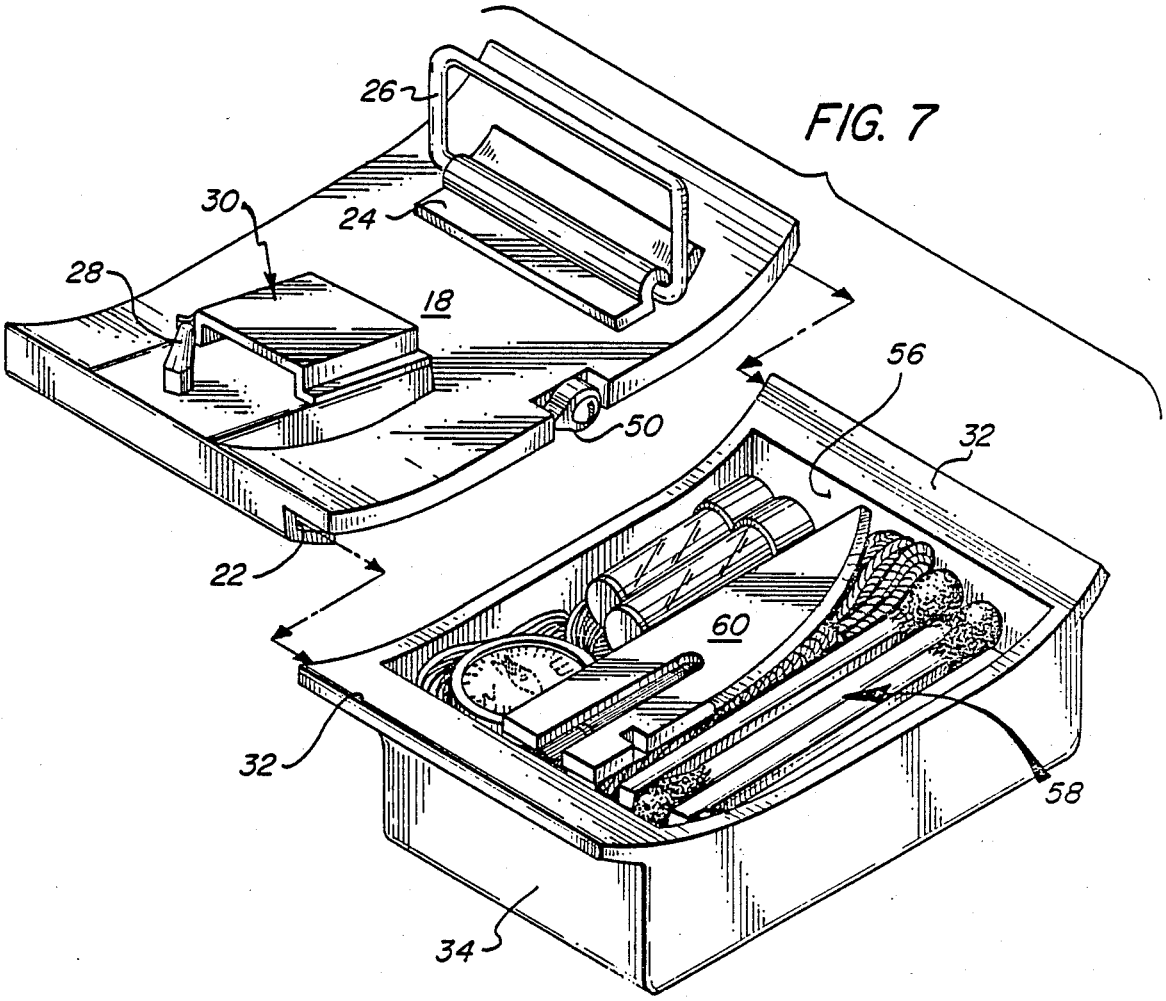
FIG. 7 is an exploded perspective view of the survival belt buckle illustrating survival items and an elongated knife blade within the compartment defined by the case.

Referring now to FIG. 7, with the latch 50 moved to its open position, ninety degrees (90°) from its closed position, the case 34 can be slid from the curved slots 22 to expose an interior compartment 56 defined within the case 34. As can be seen in FIG. 7 the compartment is filled with basic items generally indicated by the numeral 58 which can aid the user of the belt buckle 16 in wilderness survival. These items 58 can be chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

Dimensionally sized to fit within the compartment 56 along with the items 58 is a knife blade 60. As can be more clearly understood when considering FIGS. 8 and 9, the knife blade 60, removed from the compartment 56, can be inserted in the knife blade retainer 30 to permit the survival belt buckle to function as a handle for the knife blade 60.

The knife blade 60 is provided with a sharpened, pointed end 62 used for cutting and a square, connecting end 64 which interconnects with the blade retainer 30 to secure the knife blade 60 to the survival belt buckle. The square, connecting end 64 of the knife blade 60 has a elongated groove 66 terminating approximately in the middle of the knife blade 60 and a notch 68 on one side thereof.

The knife blade retainer 30 comprises a platform 70 which provides a level surface for mounting the knife blade 60, a U-shaped member 72 having two side walls 74 extending outwardly from the platform 70 with a traversing wall 76 therebetween defining a channel for receiving the square, connecting end 64 of the knife blade 60, and a locking spring 78 mounted on one of the side walls 74 for movement through manual engagement and manipulation by the user between a fully seated position within an opening 80 in the side wall and extending into the notch 68 in the knife blade 60 (note the full line position in FIG. 9) and a retracted position withdrawn from the opening 80 and notch 68 (note the phantom line position in FIG. 9). In the fully seated position of the locking spring 78, the knife blade 60 is locked to the belt buckle 16. When the locking spring 78 is in its retracted position, the knife blade 60 can be moved by the user longitudinally as illustrated by arrow 84 to remove or insert the knife blade 60 as desired. It should be noted that the belt retaining hook 28 extends through the elongated groove 66 of the knife blade 60 as illustrated in FIG. 8 to limit longitudinal movement of the knife blade 60 and to provide a bearing point or surface when the assembled knife blade 60 and base plate 18 are used in a cutting operation.

Although the compartment 56 contains the basic items 58 which can be used in wilderness survival, the inexperienced person put in a survival situation requiring use of these items would not necessarily know the proper survival techniques and skills. In order to make the survival belt buckle 16 most useful, indicia in the form of a description of basic survival skills and techniques, are printed or engraved on the various surfaces of the belt buckle 16 as indicated by numeral 82. The skills and techniques described include starting and maintaining a fire; locating and purifying water; finding and/or constructing shelter; emergency signalling; and orientation. Alternatively, the indicia can be printed on plastic laminated cards which fit on the floor of the case 34 to be removed and utilized in survival situations. The compartment 56 can also be used to hide or protect valuables.

The survival belt buckle 16 is preferably made of rugged brass material but it should be apparent to those skilled in the art that it may be manufactured from other suitable materials such as plastic resin.

Thus, it can be seen from the foregoing specification and the attached drawings that the survival belt buckle of the present invention provides an effective means for providing a degree of safety for those who venture into the out-of-doors.

The preferred embodiment described above admirably achieves the objects of the invention; however, it will be appreciated that departures can be made by those skilled in the art without departing from the spirit and scope of the invention which is limited only by the following claims.

Having thus described the invention, what is claimed is:

1. A survival belt buckle for use in combination with an elongated belt for releasably securing the ends thereof when worn around the waist of the user comprising:

(a) a base having means for releasably securing the ends of the elongated belt;

(b) means on said base defining a compartment;

(c) means releasably retained in said compartment for aiding in the survival of the user; and (d) a knife blade adapted to be releasably secured to said base in a releasably secured position so that said base functions as a handle for said knife blade and dimensionally sized to fit within said compartment in a released position unattached to said base whereby said base acts as a handle for said knife blade when said knife blade is in its releasably secured position.

2. A survival belt buckle in accordance with claim 1 wherein said base includes a knife blade retainer within which said knife blade is releasably retained.

3. A survival belt buckle in accordance with claim 2 wherein said knife blade retainer defines a channel within which said knife blade is received.

4. A survival belt buckle in accordance with claim 3 wherein said knife blade received within said retainer includes a notch and said knife blade retainer has a locking spring dimensionally sized to enter said notch and retain said knife blade within said channel.

5. A survival belt buckle in accordance with claim 4 wherein said knife blade retainer is a U-shaped member having two upstanding side walls mounted on said base with a traversing wall therebetween to define said channel, one of said side walls having an opening providing access into said channel, said locking spring mounted on said one side wall for movement between a seated position within said opening and extending into said channel and a retracted position withdrawn from said opening and channel.

6. A survival belt buckle in accordance with claim 5 wherein said locking spring, in its seated position, extends into said notch of said knife blade to releasably secure said knife blade in said channel.

7. A survival belt buckle in accordance with claim 2 wherein said means for releasably securing the ends of the elongated belt includes a belt hook spaced from said knife blade retainer.

8. A survival belt buckle in accordance with claim 7 wherein said knife blade includes an elongated slot dimensionally sized to receive said belt hook whereby said belt hook is adapted to be received within said elongated slot.

9. A survival belt buckle in accordance with claim 2 wherein said base is a base plate and said means on said base is a case defining said compartment attached to said base plate.

10. A survival belt buckle in accordance with claim 9 wherein said base plate defines front and back sides and has said means for releasably securing the ends of an elongated belt mounted on the back side thereof and means releasably mounting said case on the front side thereof.

11. A survival belt buckle in accordance with claim 10 wherein said means releasably mounting said case includes L-shaped flanges cantilevered from said base plate and defining slots for receiving said case.

12. A survival belt buckle in accordance with claim 11 wherein said case has a generally rectangular configuration comprising a generally rectangular face plate, and a pair of end walls and a pair of side walls extending from said face plate to define said compartment, said end walls having extending shoulders releasably received in said slots of said base plate.

13. A survival belt buckle in accordance with claim 12 wherein said base plate has a rotating lock for holding said case in place within said slots defined by said L-shape flanges of said base plate.

14. A survival belt buckle in accordance with claim 9 further including indicia, associated with said case and base plate, in the form of a description of basic survival skills and techniques.

15. A survival belt buckle in accordance with claim 14 wherein said indicia are engraved on said case and base plate.

16. A survival belt buckle in accordance with claim 14 wherein said means releasably retained in said compartment comprises various items chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

17. A survival belt buckle in accordance with claim 2 wherein said means releasably retained in said compartment comprises various items chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

18. A survival belt buckle in accordance with claim 1 wherein said base is a base plate and said means on said base is a case defining said compartment attached to said base plate.

19. A survival belt buckle in accordance with claim 18 wherein said base plate defines front and back sides and has said means for releasably securing the ends of the elongated belt mounted on the back side thereof and means releasably mounting said case on the front side thereof.

20. A survival belt buckle in accordance with claim 19 wherein said means releasably mounting said case includes L-shaped flanges cantilevered from said base plate and defining slots for receiving said case.

21. A survival belt buckle in accordance with claim 20 wherein said case having a generally rectangular configuration comprising a generally rectangular face plate, and a pair of end walls and a pair of side walls extending from said face plate to define said compartment, said end walls having extending shoulders received in said slots of said base plate.

22. A survival belt buckle in accordance with claim 21 wherein said base plate has a rotating lock for holding said case in place within said slots of said base plate.

23. A survival belt buckle in accordance with claim 18 further including indicia, associated with said case and base plate, in the form of a description of basic survival skills and techniques.

24. A survival belt buckle in accordance with claim 23 wherein said indicia are engraved on said case and base plate.

25. A survival belt buckle in accordance with claim 23 wherein said means releasably retained in said compartment comprises various items chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

26. A survival belt buckle in accordance with claim 18 wherein said means releasably retained in said compartment comprises various items chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

27. A survival belt buckle in accordance with claim 1 wherein said means releasably retained in said compartment comprises various items chosen from a group consisting of waterproof matches, nylon cord, snare wire, metal match, fishing line, fishing hooks, split shot, fire starter, compass, sugar and salt in plastic containers, fresnel lens, signal mirror and halazone tablets.

28. A survival belt buckle for use in combination with an elongated belt for releasably securing the ends thereof when worn around the waist of the user comprising:

(a) a base having means for releasably securing the ends of the elongated belt;
(b) means on said base defining a compartment;
(c) means releasably retained in said compartment for aiding in the survival of the user; and
(d) a knife blade releasably secured to said base in a releasably secured position and dimensionally sized to fit within said compartment whereby said base acts as a handle for said knife blade when said knife blade is in its releasably secured position, said base includes a knife blade retainer within which said knife blade is releasably retained, said knife blade retainer defines a channel within which said knife blade is received.

29. A survival belt buckle in accordance with claim 28 wherein said knife blade received within said retainer includes a notch and said knife blade retainer has a locking spring dimensionally sized to enter said notch and retain said knife blade within said channel.

30. A survival belt buckle in accordance with claim 29 wherein said knife blade retainer is a U-shaped member having two upstanding side walls mounted on said base with a traversing wall therebetween to define said channel, one of said side walls having an opening providing access into said channel, said locking spring mounted on said one side wall for movement between a seated position within said opening and extending into said channel and a retracted position withdrawn from said opening and channel.

31. A survival belt buckle in accordance with claim 30 wherein said locking spring, in its seated position, extends into said notch of said knife blade to releasably secure said knife blade in said channel.

32. A survival belt buckle for use in combination with an elongated belt for releasably securing the ends thereof when worn around the waist of the user comprising:

(a) a base having means for releasably securing the ends of the elongated belt;
(b) means on said base defining a compartment;
(c) means releasably retained in said compartment for aiding in the survival of the user; and
(d) a knife blade releasably secured to said base in a releasably secured position and dimensionally sized to fit within said compartment whereby said base acts as a handle for said knife blade when said knife blade is in its releasably secured position, said base includes a knife blade retainer within which said knife blade is releasably retained, said means for releasably securing the ends of the elongated belt includes a belt hook spaced from said knife blade retainer, an end of said knife blade includes an elongated slot dimensionally sized to receive said belt hook whereby said belt hook is adapted to be received within said elongated slot.

* * * * *